US011118402B2

(12) United States Patent
Piispanen et al.

(10) Patent No.: US 11,118,402 B2
(45) Date of Patent: Sep. 14, 2021

(54) ROCK DRILLING MACHINE, ROCK DRILLING RIG AND MEASURING METHOD

(71) Applicant: SANDVIK MINING AND CONSTRUCTION OY, Tampere (FI)

(72) Inventors: Juha Piispanen, Tampere (FI); Timo Leino, Tampere (FI); Sirpa Launis, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 14 days.

(21) Appl. No.: 16/717,467

(22) Filed: Dec. 17, 2019

(65) Prior Publication Data

US 2020/0199941 A1 Jun. 25, 2020

(30) Foreign Application Priority Data

Dec. 21, 2018 (EP) ..... 18215478

(51) Int. Cl.

| | |
|---|---|
| ***E21B 7/02*** | (2006.01) |
| ***E21B 47/07*** | (2012.01) |
| ***E21B 47/12*** | (2012.01) |
| *E21B 47/092* | (2012.01) |
| *E21B 47/095* | (2012.01) |

(52) U.S. Cl.

CPC ..... *E21B 7/025* (2013.01); *E21B 7/021* (2013.01); *E21B 47/07* (2020.05); *E21B 47/12* (2013.01); *E21B 47/092* (2020.05); *E21B 47/095* (2020.05)

(58) Field of Classification Search

CPC ..... E21B 7/025; E21B 47/12; E21B 47/138

See application file for complete search history.

(56) References Cited

U.S. PATENT DOCUMENTS

| | | | | |
|---|---|---|---|---|
| 4,899,816 | A | 2/1990 | Mine | |
| 6,766,854 | B2 | 7/2004 | Ciglenec et al. | |
| 2010/0270076 | A1* | 10/2010 | Ahola | F42D 1/08 175/2 |
| 2011/0280104 | A1 | 11/2011 | McClung | |
| 2012/0247839 | A1 | 10/2012 | Kosovich | |
| 2017/0314387 | A1 | 11/2017 | Yang et al. | |

FOREIGN PATENT DOCUMENTS

| | | | |
|---|---|---|---|
| CL | 49713 | | 5/2009 |
| CL | 58088 | | 10/2019 |
| DE | 102016003749 | A1 | 10/2017 |
| EP | 0860907 | A2 | 8/1998 |
| WO | 2009083644 | A1 | 7/2009 |
| WO | 2011004183 | A2 | 1/2011 |
| WO | 2015003188 | A1 | 1/2015 |

* cited by examiner

*Primary Examiner* — Kristyn A Hall

(74) *Attorney, Agent, or Firm* — Corinne R. Gorski

(57) ABSTRACT

A rock drilling machine, rock drilling rig and method of measuring physical features during rock drilling is provided. The rock drilling machine includes one or more sensing devices, which are arranged in connection with a bendable sensing cord. The sensing cord is fed via a feed passage to a flushing passage of a drilling tool.

6 Claims, 5 Drawing Sheets

ROCK DRILLING MACHINE, ROCK DRILLING RIG AND MEASURING METHOD

RELATED APPLICATION DATA

This application claims priority under 35 U.S.C. § 119 to EP Patent Application No. 18215498.9, filed on Dec. 21, 2018, which the entirety thereof is incorporated herein by reference.

TECHNICAL FIELD

The invention relates to a rock drilling machine provided with sensing means for gathering sensing data during the drilling process. The invention further relates to a rock drilling rig and method measuring at least one physical feature during rock drilling.

BACKGROUND

In mines, construction sites and at other work areas different type of rock drilling rigs are used. The rock drilling rigs are provided with one or more booms and rock drilling units are arranged at distal ends of the booms for drilling drill holes.

Accurate and effective drilling requires measuring and data gathering during the drilling process. Conventional sensing is executed by sensing devices locating outside the drill hole. However, there are solutions in which sensing devices are integrated with the drilling tool, either to drilling tubes or to a drill bit. These sensing devices are subjected to great mechanical loadings and impact pulses causing the sensing device to fail. Furthermore, data transmission from the bottom of the drill hole has been a huge problem.

SUMMARY

An object of the invention is to provide a novel and improved rock drilling machine, a rock drilling rig and method for executing measuring during the drilling.

An aspect of the disclosed solution is that a basic structure of a rock drilling machine includes a body and a rotation device, which is configured to rotate a rotation element around its longitudinal axis. The rotation element is located at a front end portion of the body and is connectable to a drilling tool. The drilling tool is provided with a central flushing passage allowing flushing agent to be fed through the drilling tool to the drilled hole. The drilling machine is also provided with one or more sensing devices.

Further, the structure of drilling machine includes a feed passage allowing feeding of a sensing cord through it to the flushing passage of the drilling tool. The sensing cord is an elongated, bendable element configured to be inserted through the feed passage to the central flushing passage of the connectable drilling tool. In this manner, the feed passage and the flushing passage are connected to each other. The one or more sensing devices are arranged in connection with the sensing cord. In other words, the one or more sensing devices may be entered inside the drilling tool by means of the sensing cord.

An advantage of the disclosed solution is that durability of the sensing system is improved. The disclosed solution allows collecting of data during the drilling process and close to the monitored target element or target point. The sensing cord provides the sensing device with a continuous physical contact whereby the sensing device is continuously under control and its movements can be controlled accurately. When the sensing device is inside the flushing passage during drilling, mechanical impacts, forces, heat and other harmful effects may be avoided. This way operating life of the sensing device may be longer and in case the sensing device fails, it is simple and quick to change.

A further advantage of the disclosed solution is that it allows different type of sensors to be utilized. Thereby the solutions provide a versatile sensing system for the drilling.

According to an embodiment, the sensing device is movable relative to the drilling tool during the drilling. Accordingly, the sensing device may be moved to a desired position inside the flushing passage in order to generate monitoring data on desired portion or element of the drilling tool.

According to an embodiment, the feed opening feature includes rear-feeding, side-feeding, feeding through the piston, feeding via the rotation element, feeding through an adapter element, etc.

According to an embodiment, the sensing cord is provided with a separate sensing device or the sensing cord serves as the sensing device itself.

According to an embodiment, the disclosed solution is implemented in rotary drilling. In this manner, the sensing cord is fed via a rotation head or rotation hub and its torque transmitting machine elements to the flushing channel of the drilling tool.

According to an embodiment, the rotation element of the rock drilling machine is a torque transmitting machine element. Thus, the rotation element may be a shank or a rotation hub, for example.

According to an embodiment, the disclosed solution is implemented in percussion drilling.

According to an embodiment, the disclosed solution is implemented in top hammer drilling, wherein the impact device and the rotation device are located at an opposite end of the drilling tool relative to a drill bit facing the rock to be drilled. The sensing cord may be fed through a rotation element of a rotation device.

According to an embodiment, the disclosed solution is implemented in down-the-hole (DTH) drilling, wherein the impact device is located close to the drill bit and at the opposite end of the drilling tool relative to the rotation device. The sensing cord is fed through a rotation element of a rotation head or rotation hub.

According to an embodiment, the disclosed solution is implemented in extension rod drilling or long hole drilling. Thus, the drilling tool includes two or more hollow extension rods and a drill bit at a distal end of the drilling tool.

According to an embodiment, the disclosed solution is implemented in face drilling. Accordingly, the drilling tool includes one single hollow drill rod and a drill bit at a distal end of the drilling tool.

According to an embodiment, the rotation element, such as the shank, is provided with a central widened section extending an axial distance from a front end of the shank towards the rear end. Accordingly, the rotation element or shank may receive the sensing device or unit, which is located at the distal end of the sensing cord, inside the widened section, and may thereby provide shelter for the sensing instrument during changes of the drilling tools.

According to an embodiment, the sensing cord is led axially through the body of the rock drilling machine. In other words, there are no separate elements such as adaptors provided with cord feeding means between the drilling tool and the rock drilling machine. The body of the rock drilling machine includes a feed port, which may be located at a rear end of the body. Thus, the solution implements a rear feeding principle. However, the feed port may also be located elsewhere than at a rear end in the body structure. An advantage of the axial rear feeding is that no rotational connectors and other sensitive and easily failing machine components needs to be used.

According to an embodiment, the rock drilling machine includes side feeding means and features. The rock drilling machine includes at least one feed port located on a side of the body. In other words, the rock drilling machine includes a side feeding connection between the rotation device and the rear cover.

According to an embodiment, the feed passage extends axially through the entire rock drilling machine. Thus, the feeding of the sensing cord implements a rear feeding principle. An advantage of the rear feeding is the feeding system may be mounted on the same axial line with the rotating machine elements of the rock drilling machine whereby use of complicated rotational joints and connecting elements may be avoided. Further, in some constructions there is more free space for arranging the feed passage and the needed feeding means at the rear of the rock drilling machine than anywhere else in the machine.

According to an embodiment, the body of the rock drilling machine includes a rear cover at a rear end of the rock drilling machine and opposite to a front end provided with the shank; and the rear cover includes an opening allowing passage of the sensing cord through the rear cover.

According to an embodiment, the feed passage has a first opening on a side of the rock drilling machine and a second opening of it is in connection with the flushing passage, whereby feeding of the sensing cord implements a side feeding principle.

According to an embodiment, the rock drilling machine includes an impact device. Further, the mentioned feed passage passes also through the impact device.

According to an embodiment, the impact device includes a percussion piston arranged movably inside the body and configured to strike a rear end of the shank, and wherein the percussion piston includes a central opening extending axially through the percussion piston and being in constant connection with the corresponding opening of the shank.

According to an embodiment, the impact device includes an elongated impact element configured to generate impact pulses directed to the shank.

According to an embodiment, the mentioned feed passage is in fluid connection with a flushing feed port whereby the sensing opening is configured to serve also as a fluid conduit through which flushing fluid is conveyed to the drilling tool. In other words, the sensing cord and the flushing system utilize the same feed system.

According to an embodiment, the feed passage of the sensing cord is connected to a same space with a flushing system. Thus, the feed passage may be connected to a flushing chamber surrounding a portion of the rotation element. The sensing cord may then be conveyed via the flushing chamber to the flushing passage of the drilling tool.

According to an embodiment, the at least one sensing device is connected to a distal end portion of the sensing cord.

According to an embodiment, the sensing device is a sensor or measuring instrument.

According to an embodiment, the at least one sensing device is connected directly to the sensing cord.

According to an embodiment, at the distal end of the sensing cord is a sensing unit provided with one or more sensing devices.

According to an embodiment, the one or more sensing devices are connected at distances from the distal end of the sensing cord.

According to an embodiment, at least two different types of sensing devices are connected to the sensing cord or are located at a sensing unit.

According to an embodiment, the sensing cord itself is configured to serve as the sensing device. Thus, the sensing cord may be a sensor based on fiber optics.

According to an embodiment, one or more miniature sensing devices which may be integrated into the structure of the sensing cord.

According to an embodiment, the at least one sensing device is one of the following: audio sensor, temperature sensor, acceleration sensor, force sensor, position sensor, camera, gyroscope or electromagnetic sensor.

According to an embodiment, in practice the sensing device may include one or more of the following devices: IR-sensor, IR-camera, strain gauge, optical fibre sensor, microphone, vibration sensor, laser scanner, LIDAR, video camera, inductive sensor.

According to an embodiment, the one or more sensing devices implemented in the disclosed solution are without physical fixed connection with the drilling tool, whereby their operating life may be long.

According to an embodiment, the sensing device may be positioned inside the drilling tool at a distance from the drill bit where the greatest accelerations exist. This way, the operating life of the sensing device may be extended.

According to an embodiment, the sensing cord includes at least one data transmission element, whereby the sensing cord has dual purpose serving as a mechanical force transmitting element and as data transmitting element.

According to an embodiment, cross-section of the sensing cord includes an outer casing configured to transmit at least longitudinal forces and providing mechanical protection for the data transmission element inside the outer casing. Thus, the cross-section of the sensing cord may be tubular, whereby the data transmission element is inside a hollow inner space, or alternatively, the inner space limited by the outer casing is filled with a filling material after the transmission element has been inserted through it.

According to an embodiment, the sensing cord needs to be able to transmit at least tension forces. However, when the sensing cord is used also for feeding the sensing device inside the drilling tool, then it needs to be able to transmit also erection forces, i.e. it should then have erection rigidity.

According to an embodiment, the sensing cord may also have torsion rigidity so that the distal end of the sensing cord has substantially the same turning position as the portion that is out of the drilled hole. Thus, rotational position of the sensing device inside the drilling tool can be determined at the rock drilling machine end of the sensing cord.

According to an embodiment, the sensing cord may transmit pulling, pushing and turning forces, and may also transmit data.

According to an embodiment, the sensing cord may have an envelope, casing or cover, which is configured to transmit at least longitudinal forces. Accordingly, inside the outer material of the cord may be located wires and other sensitive elements. Thus, the enveloping materials provides a protective casing for data transmission means, for example.

According to an embodiment, the data transmission feature of the sensing cord may be based on electrical conductivity, or alternatively it may be based on transmitting light or radio frequency signals.

According to an embodiment, the sensing cord is configured to serve as an antenna and the sensing device includes a transmitter and co-operates with the mentioned antenna. The rock drilling machine may have a receiver which transmits signals from the sensing device.

According to an embodiment, the rock drilling machine includes a transfer device for moving the sensing cord longitudinally and relative to the drilling tool.

According to an embodiment, the mentioned transfer device is configured to move the sensing cord longitudinally at least in reverse direction towards the rock drilling machine.

According to an embodiment, the transfer device is configured to move the sensing cord longitudinally towards a drill bit of the drilling tool and reversing the sensing cord towards the rock drilling machine. In other words, the transfer device is utilized in feeding and reversing the disclosed measuring and monitoring instruments.

According to an embodiment, the transfer device is configured only to reverse the sensing cord since the feeding of the sensing device and the connected sensing cord is executed by means of pressurized fluid flow. Then compressed air or water may be directed to rear end of the sensing device and the fluid flow conveys the sensing device towards the distal end of the drilling tool. The rear end of the sensing device or unit may have one or more free surfaces so that the pressurized fluid may influence on them.

According to an embodiment, in connection with the transfer device, or alternatively at a distance from it, may be a reel for winding the bendable sensing cord.

According to an embodiment, in connection with the transfer device, or alternatively at a distance from it, may be a storage space for receiving the bendable sensing cord. The storage space may have circular inner walls which may guide the cord properly inside the space.

According to an embodiment, the transfer device may be spring actuated, when it is used only for the reversing function.

According to an embodiment, the transfer device may be provided with a feed actuator having at least two opposite rolls or wheels between which the sensing cord is passing, and at least one motor for rotating at least some of the rolls or wheels for directing an axial force to the sensing cord.

According to an embodiment, in connection with the transfer device may be at least one measuring wheel, or corresponding instrument, for determining axial position of the sensing device inside the drilling tool.

According to an embodiment, in connection with the transfer device may be at least one detector or measuring instrument for detecting rotational position of the sensing cord. The produced data may be utilized for determining position of the sensing device at an opposite end portion of the sensing cord.

According to an embodiment, the sensing device is configured to be in online data transmission with at least one control unit which is located outside the drilled hole.

According to an embodiment, the sensing and measuring may be executed during the drilling and the generated data may be transmitted further without a delay.

According to an embodiment, the sensing device or unit is in wired data transmission with a control unit of a rock drilling machine.

According to an embodiment, the sensing device or unit is in wireless data transmission with a control unit of a rock drilling machine.

According to an embodiment, the disclosed solution relates to a rock drilling rig comprising a movable carrier, one or more drilling booms and a drilling unit at a distal end part of the drilling boom. The drilling unit includes a feed beam and a rock drilling machine supported movably on the feed beam. The drilling unit is further provided with sensing means for providing sensing data during rock drilling. The sensing means comprise at least one sensing device configured to be inserted through the rock drilling machine to a central flushing passage of a drilling tool together with a sensing cord. The rock drilling machine may further have features and issues disclosed in the previous embodiments above.

According to an embodiment, the disclosed solution relates to a method of measuring at least one physical feature during rock drilling. The method includes the step of executing the drilling of drill holes by means of a rock drilling machine and a drilling tool connected to a shank of the rock drilling machine. The method further includes generating measuring data during the drilling by means of one or more sensing devices which are separate pieces relative to the drilling tool, and which are feed to a central flushing passage of the drilling tool through the rock drilling machine. The sensing devices are controlled inside the flushing passage by means of a sensing cord.

According to an embodiment, the disclosed method further includes supporting the at least one sensing device inside the flushing passage of the drilling tool by means of a sensing cord.

According to an embodiment, the disclosed method further includes keeping axial position of the at least one sensing device unchanged by means of the sensing cord despite of forces caused by the flushing flow inside the flushing path. In other words, axial position of the inserted at least one sensing device is determined by the sensing cord.

According to an embodiment, the disclosed method further includes retracting the at least one sensing device inside an axial opening of the shank for the duration of change of drilling components of the drilling tool, whereby the sensing device is sheltered by the structure of the shank.

According to an embodiment, the disclosed method further includes altering axial position of the at least one sensing device relative to the drilling tool and producing sensing data at several different axial locations of the drilling tool.

According to an embodiment, the disclosed method further includes executing a pre-determined measuring sequence automatically during the drilling. The measuring sequence includes moving the sensing device inside the flushing passage to at least two separate positions during the measuring sequence, whereby several desired measurements are executed automatically.

According to an embodiment, the disclosed method further includes executing on-line measurements during the drilling operation and transmitting the generated measuring data on-line to at least one control unit external to the drilled drill hole.

According to an embodiment, the disclosed method further includes transmitting the measuring data through wired data transmission path on-line to the external control unit.

According to an embodiment, the disclosed method further includes feeding the at least one sensing device inside the flushing passage of the drilling tool by means of the sensing cord which is moved towards a distal end of the drilling tool by means of at least one transfer device.

According to an embodiment, the disclosed method further includes feeding the at least one sensing device and the sensing cord towards the drill bit by means of flushing fluid flow inside the flushing passage of the drilling tool and retracting them by means of the transfer device.

According to an embodiment, the disclosed method further includes measuring feed length of the sensing cord relative to the rock drilling machine in order to determine distances between the at least one sensing device and the rock drilling machine.

According to an embodiment, the disclosed method further includes using torque resistant sensing cord and detecting position of the one or more sensing devices relative to a central axis of the sensing cord. The turning position of the sensing cord may be detected by means of a detector or sensor, which is located outside the drill hole. The detector may be in connection with the mentioned transfer device, for example.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION

Figure 1:
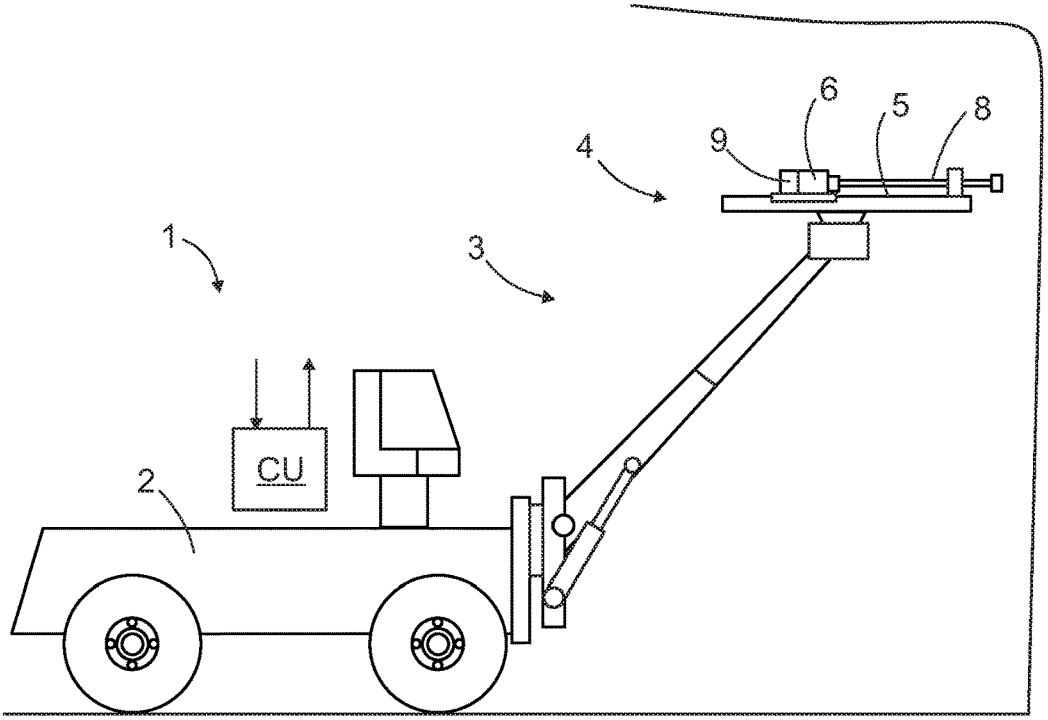
FIG. 1 is a schematic side view of a rock drilling rig for underground drilling and being provided with a drilling boom with a drilling unit.

FIG. 1 shows a rock drilling rig 1. The rock drilling rig 1 includes a movable carrier 2 and at least one drilling boom 3 connected to the carrier 2. At a distal end portion of the boom 3 is a drilling unit 4. The drilling unit 4 may include a feed beam 5 and a rock drilling machine 6 supported on it. The rock drilling machine 6 may have a rotation device 7 for rotating a drilling tool 8. The rock drilling machine 6 further includes an impact device 9 for generating impact pulses to the drilling tool 8. The disclosed rock drilling rig implements top hammer drilling principle. The rock drilling rig 1 further includes one or more control units CU configured to control operation on the basis of received sensing data and control instructions.

Figure 2:
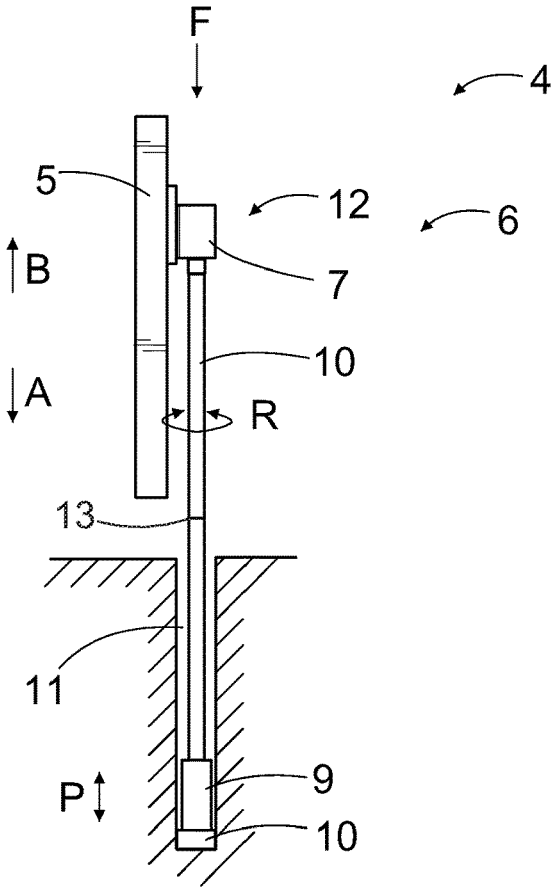
FIG. 2 is a schematic side view of a drilling unit implementing down the hole (DTH) drilling principle.

FIG. 2 discloses a DTH drilling unit 4, which has an impact device 9, which is located at a distal end portion of the tool 8 and generates impact pulses P for a drill bit 10. The impact device 9 is located inside a drill hole 11 and it is typically operated by means of pressurized air. Thus, pressurized air is needed for actuating the impact device 9 and also for flushing drilling cuttings out of the formed drill hole 11. The needed pressure for the air is generated by means of a compressor system including at least one compressor.

The drilling tool 8 is rotated R by means of a rotation device 7 and is also fed (F) in a drilling direction A during the drilling. The drilling tool 8 may be reversed in direction B. The rotation device 7 is part of a rotation head 12 which is movable on the feed beam 5 by means of a feed device, which is not shown in FIG. 2. As can be noted the drilling tool 8 may include several successive extension tubes or components and joints 13 between them.

The rock drilling machines 6 disclosed in FIGS. 1 and 2 may be equipped with the measuring system and its embodiments disclosed in this application.

Figure 3:
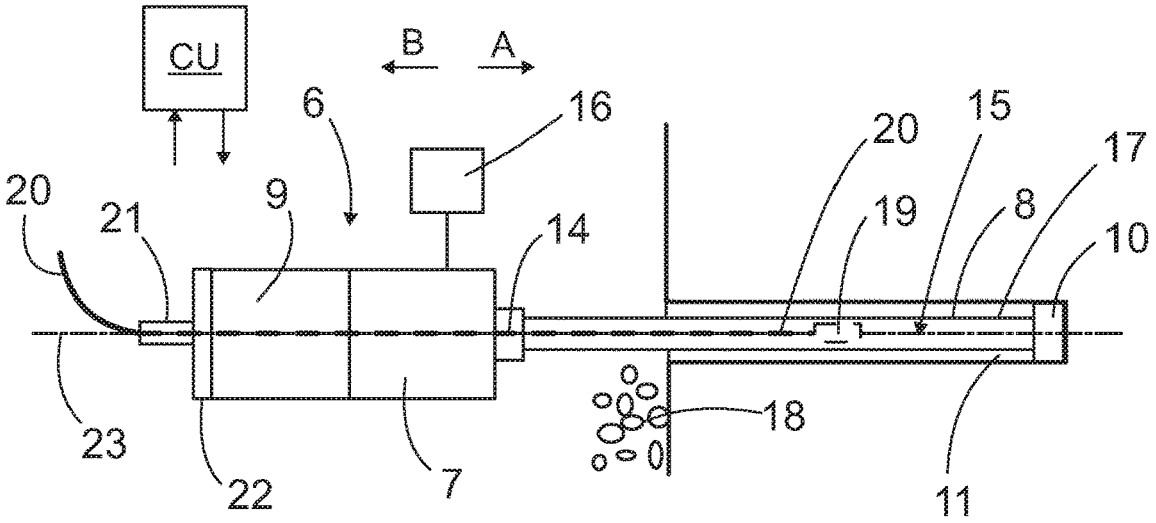
FIG. 3 is a schematic side view of a rock drilling machine, which is provided with a system for feeding a sensing cord from behind through the rock drilling machine inside a drilling tool.

FIG. 3 discloses that a rotation device 7 of a rock drilling machine 6 rotates a rotation element 14, such as a shank. The rotation element 14 is located at a front end portion of a body of the rock drilling machine 6 and is connected to a drilling tool 8 provided with a central flushing passage 15. For clarity reasons the flushing passage 15 is shown in FIG. 3 only by means of an arrow.

The flushing passage 15 of the tool 8 is in fluid connection with a flushing device 16 for feeding flushing agent, such as pressurized water or air, through a tubular rod 17 or drilling tube of the tool 8 to a drill bit 10 in order to flush drilling cuttings 18 out of the drill hole 11.

Inside the flushing passage 15 is one or more sensing devices 19, which are separate sensing or monitoring components relative to the drilling tool 8. The sensing device 19 is connected to a sensing cord 20, whereby the sensing device 19 is continuously mechanically connected to a connection point external to the drilling tool 8. The sensing cord 20 is an elongated bendable element, which facilitates its insertion inside the flushing passage 15. The sensing cord 20 may at first be fed through a feed opening 21 inside the rock drilling machine 6 and then inside the flushing passage 15. Due to the bendable structure of the sensing cord 20, the feed passage 21 needs not to be in line with the axial line of the flushing passage 15. However, in FIG. 3 this is the case, since rear feeding of the sensing cord 20 is disclosed.

A rear cover 22 may be provided with the feed passage 21 and needed guiding and sealing means allowing the penetration. When the sensing cord 20 and the sensing device 19 are located on a drilling axis 23, then no rotation elements are needed in connection with feed and support means of the sensing cord 20, which simplifies the structure. Sensing data produced by means of the one or more sensing devices 20 may be transmitted to one or more control devices CU or other electrical devices by means of wired or wireless data communication path.

Figure 4:
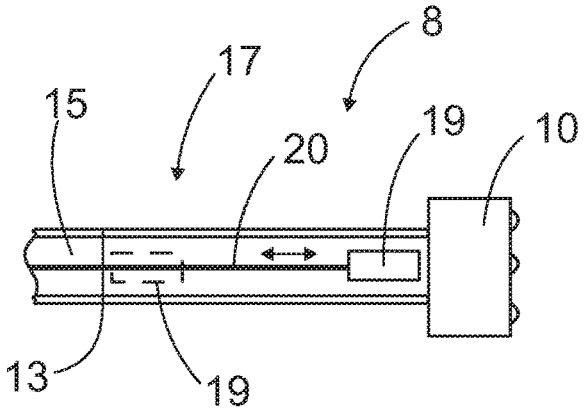
FIG. 4 is a schematic and partly sectional view of a front end portion of a drilling tool and a sensing device arranged movably inside a flushing passage of the drilling tool.

As shown in FIG. 4, the sensing device 19 inside a flushing passage 15 may be supported close to a drill bit 10 by means of the sensing cord 20 and still the sensing device 19 is not in contact with the drill bit 10 and is therefore not subjected to impact pulses and other heavy loadings. FIG. 4 also discloses that the sensing device 19 may be moved inside the flushing passage 15. The sensing device 19 may be moved at a joint 13 between successive drilling tubes.

Figure 5:
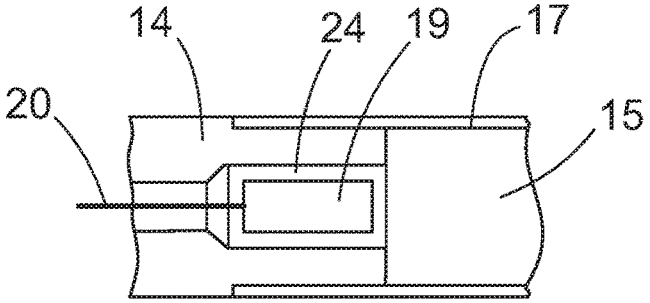
FIG. 5 is a schematic and partly sectional view of a front end portion of a rotation element provided with a space for receiving a sensing device for the duration of tool handling process.

FIG. 5 discloses that a rotation element 14 may have an open space 24 at its front end. The space 24 may receive a sensing device 19 when being retracted by means of a sensing cord 20 when extension rod or tube system is disassembled.

Figure 6:
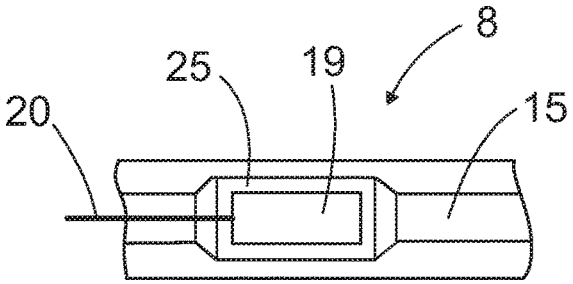
FIG. 6 is a schematic and partly sectional view of a detail of a drilling tool, which is provided with a measuring portion wherein a flushing passage includes a widened section.

FIG. 6 discloses that a rod or tube 17 of a drilling tool 8 may include one or more portions provided with widened sections 25. The widened section 25 allows flushing fluid flowing inside a flushing passage 15 without significant throttling in the flushing flow. The widened sections may be located at such positions of the drilling tool 8 which are interesting for monitoring purposes.

Figure 7:
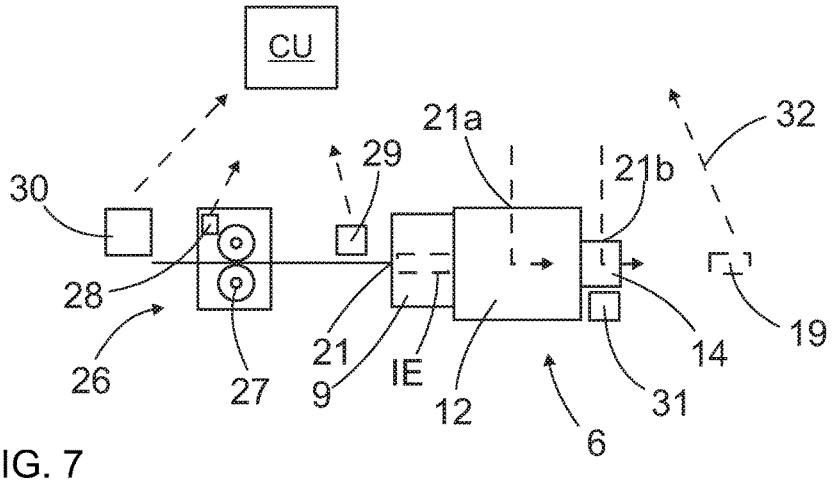
FIG. 7 is a schematic side view of a sensing cord feed system of a rock drilling machine.

FIG. 7 discloses a rock drilling machine 6 including a rotation head 12 and an impact device 9. A feed passage 21 for a sensing cord 20 may be at a rear end of the impact device 9, whereby the sensing cord 20 is fed axially. The sensing cord 20 may be fed through a percussion piston or other impact element IE of the impact device. The sensing cord 20 may be moved by means of a transfer device 26. The transfer device 26 may have opposing rotatable rollers 27, between which the sensing cord 20 passes.

Feeding length of the sensing cord 20 may be measured by a feed detector 28, which is located in connection with the transfer device 26, or alternative the detection is executed by means of an external feed detector 29. The detected feed length data is transmitted to a control unit CU in order to determining position of the sensing device 19 inside a drilling tool. In connection with the mentioned detectors 28, 29 may also be sensing means for determining rotation of the sensing cord 20 around its longitudinal axis.

Further, sensing data of the sensing device 19 may be received by means of a data collector 30, which may send the data further to a control unit CU. The data collector 30 may be located external to the rotation head 12 and may be in wired data transfer connection with the sensing device 19. Alternatively, a second data collector 31 may be located in connection with the rotation element 14 and is configured to be either in wired or wireless data transfer connection with the sensing device 19. A still further possibility is that the sensing device 19 is provided with a wireless transmitter and is configured to send the data directly 32 to the control unit CU when being retracted from the drill hole, or whenever data transmission connection is available.

FIG. 7 further discloses that the sensing cord 20 may be fed alternatively from side feed passages 21*a* or 21*b*. The side feed passage 21*a* is located at a side of the rotation head 12 and the side feed passage 21*b* is located at a side of the rotation element 14.

Figure 8:
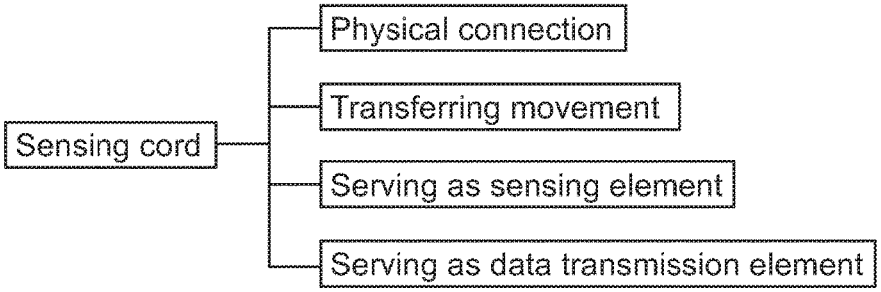
FIG. 8 is a schematic diagram showing some purposes of a sensing cord.
Figure 9:
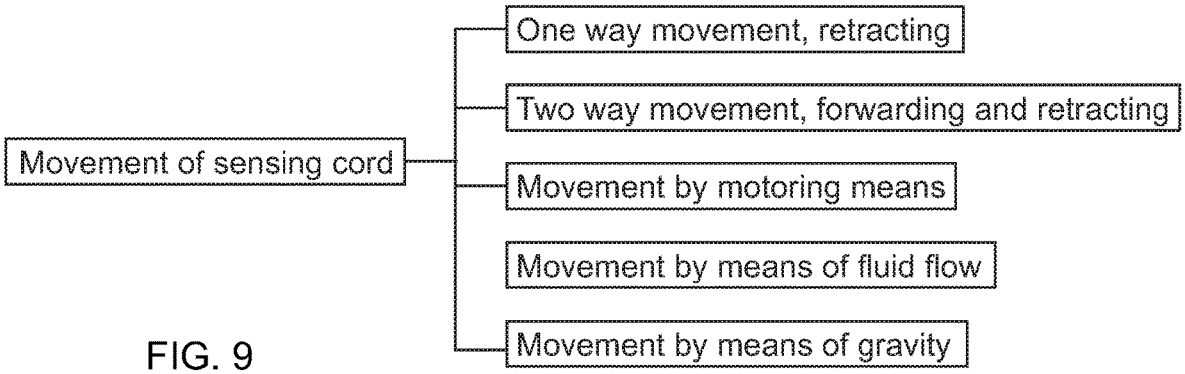
FIG. 9 is a schematic diagram showing some features relating to the movement of a sensing cord.

FIG. 8 illustrates some features relating to a sensing cord as disclosed supra. FIG. 9 discloses some features relating to movement of a sensing cord. There are several different possibilities to move the sensing cord inside a flushing passage of a drilling tool. Let it be mentioned that combinations of different movement arrangements may also be implemented.

Figure 10:
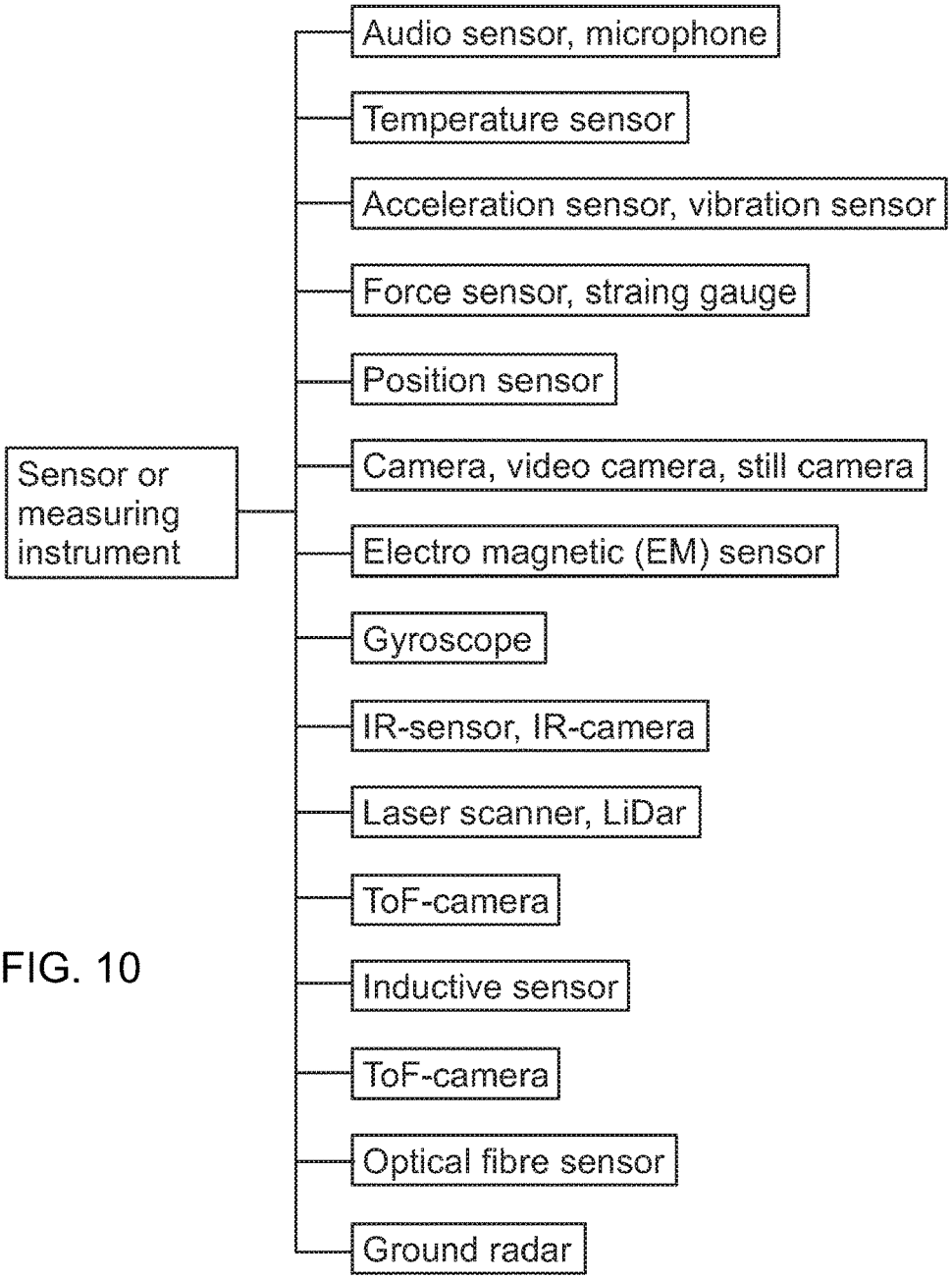
FIG. 10 is a schematic diagram showing some possible sensors or measuring devices which may be implemented in the disclosed solution.

FIG. 10 discloses some possible sensors or measuring instruments suitable for use as a sensing device. The sensing device may comprise two or more sensors whereby different sensor combinations may also be implemented.

Figure 11:
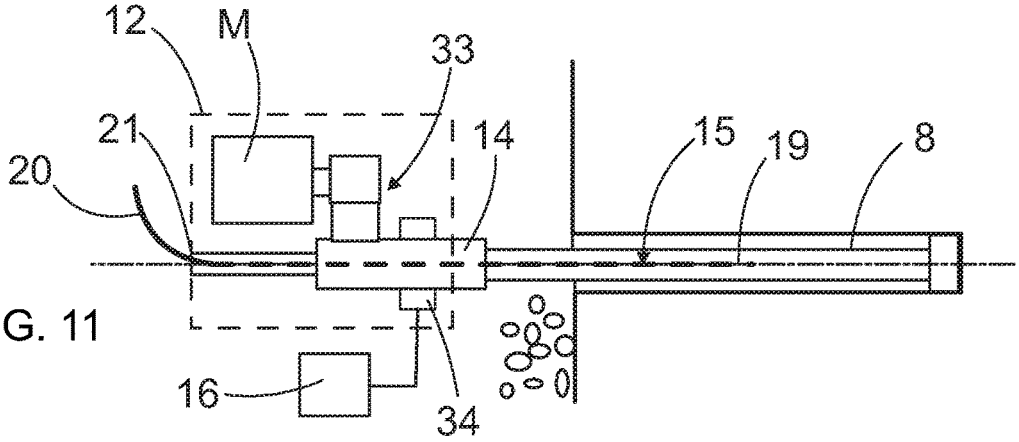
FIG. 11 is a schematic side view of a rock drilling machine comprising a rotation head through which a sensing cord is inserted inside a flushing passage of a drilling tool.

In FIG. 11 one or more sensing devices 19 are integrated to a structure of a sensing cord 20. The sensing cord 20 passes through a feed passage 21 and through a rotation element 14 of a rotation head 12. The rotation element 14 is rotated by means of a motor M and transmission gearing 33. Further, around the rotation element 14 is a flushing housing 34 connected to a flushing device 16.

Figure 12:
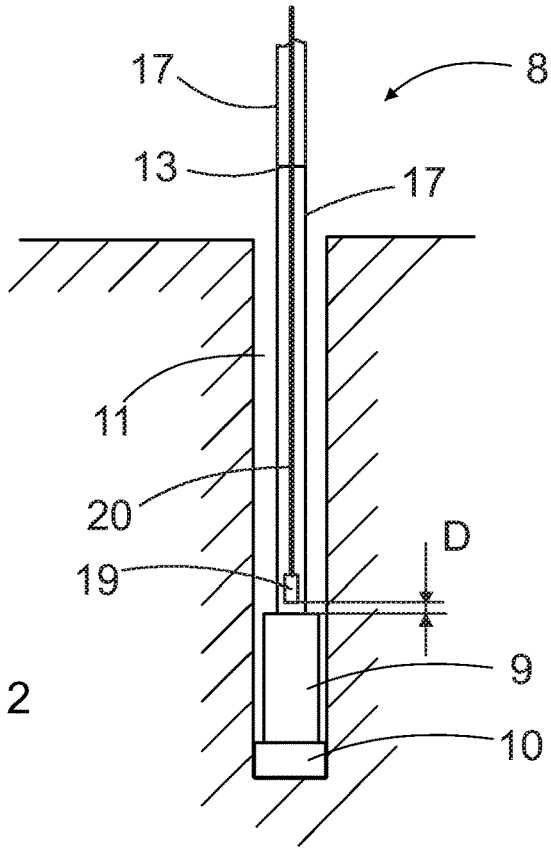
FIG. 12 is a schematic side view of a DTH drilling system and measuring arrangement inside a flushing passage of a drilling tool.

FIG. 12 discloses that in DTH drilling a sensing device 19 may be brought in a secured manner at a proximity D to an impact device 9. All the other features and issues have been already discussed above in this document.

Figure 13:
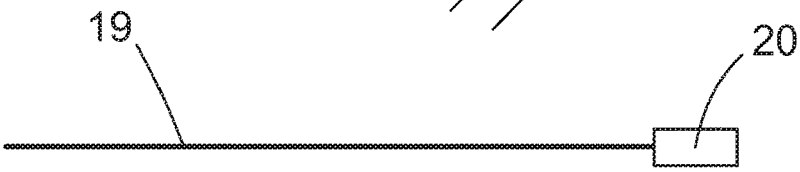
FIGS. 13-16 are schematic side views of some sensing cords provided with one or more sensing devices.
Figure 14:
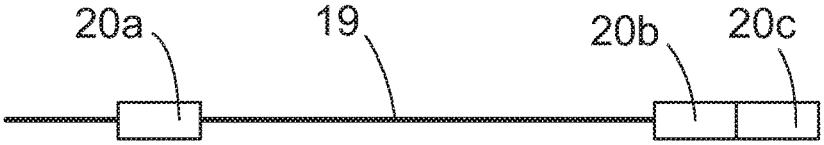
Figure 15:
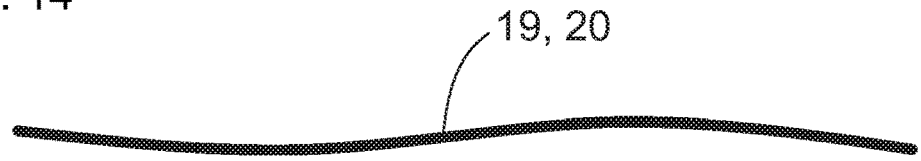
Figure 16:
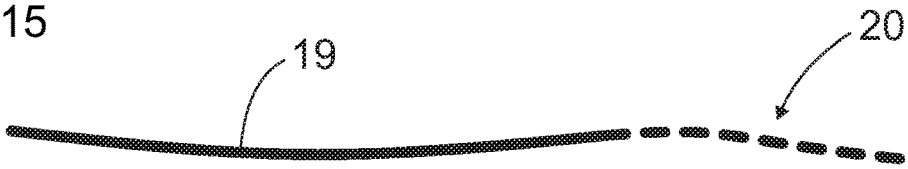

FIG. 13-16 disclose some alternative sensing cords 20 and sensing devices 19. In FIG. 13 there is one single sensing device 19 at a front part of the sensing cord 20. In FIG. 14 the sensing cord 20 is provided with several sensing devices 19*a*-19*c*. In FIG. 15 the sensing cord 20 itself serves as a sensing device 19. The sensing cord may be a fibre optical sensor, for example. In FIG. 16 the structure of the sensing cord 20 is provided with one or more integrated sensing devices 19. The integrated sensing devices 19 may be miniaturized sensors, for example. The sensing cord 20 may be a metal wire, plastic or composite string, or any other suitable bendable and elongated element.

Let it be mentioned that the disclosed sensing or monitoring system and the disclosed sensing cord and sensing device may be used for other type of drilling rigs and drilling machines. Thereby the disclosed solution may be implemented in underground drilling, production drilling, long hole drilling, surface drilling, bench drilling, exploration drilling and in any kind of drilling techniques implementing a hollow drilling tool inside which the sensing cord and the sensing device may be inserted.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A method of measuring at least one physical feature during rock drilling, the method comprising:

executing the drilling of drill holes by means of a rock drilling machine and a drilling tool connected to a shank of the rock drilling machine; and implementing the measuring of the at least one physical feature by at least one sensing device;

generating measuring data during the drilling by the at least one sensing device, which is a separate piece relative to the drilling tool; and feeding the at least one separate sensing device to a central flushing passage of the drilling tool through an impact device of the rock drilling machine and controlling the sensing device inside the flushing passage by means of a sensing cord.

2. The method as claimed in claim 1, further comprising supporting the at least one sensing device inside the flushing passage of the drilling tool by means of the sensing cord.

3. The method as claimed in claim 1, further comprising altering axial position of the at least one sensing device relative to the drilling tool and producing sensing data at several different axial locations of the drilling tool.

4. The method as claimed in claim 1, further comprising executing on-line measurements during the drilling operation and transmitting the generated measuring data on-line to at least one control unit external to the drilled drill hole.

5. The method as claimed in claim 1, wherein the at least one sensing device is fed inside the flushing passage of the drilling tool by the sensing cord, which is moved towards a distal end of the drilling tool by means of at least one transfer device.

6. The method as claimed in claim 1, further comprising measuring feed length of the sensing cord relative to the rock drilling machine in order to determine distances between the at least one sensing device and the rock drilling machine.

* * * * *